US010665165B2

(12) United States Patent
Li et al.

(10) Patent No.: US 10,665,165 B2
(45) Date of Patent: May 26, 2020

(54) ORGANIC LIGHT-EMITTING DISPLAY PANEL, ORGANIC LIGHT-EMITTING DISPLAY APPARATUS, AND DRIVING METHOD OF ORGANIC LIGHT-EMITTING DISPLAY PANEL

(71) Applicant: SHANGHAI TIANMA AM-OLED CO., LTD., Shanghai (CN)

(72) Inventors: Yue Li, Shanghai (CN); Gang Liu, Shanghai (CN); Zhonglan Cai, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 125 days.

(21) Appl. No.: 15/668,699

(22) Filed: Aug. 4, 2017

(65) Prior Publication Data

US 2018/0240405 A1 Aug. 23, 2018

(30) Foreign Application Priority Data

Feb. 22, 2017 (CN) ..... 2017 1 0096052

(51) Int. Cl.
*G09G 5/10* (2006.01)
*G09G 3/3258* (2016.01)
(Continued)

(52) U.S. Cl.
CPC ..... *G09G 3/3258* (2013.01); *G09G 3/3233* (2013.01); *G09G 3/3406* (2013.01);
(Continued)

(58) Field of Classification Search
CPC .. G09G 3/3258; G09G 3/3233; G09G 3/3406; G09G 2300/0842
(Continued)

(56) References Cited

U.S. PATENT DOCUMENTS 9,035,976 B2 5/2015 Lee et al.
2006/0248421 A1* 11/2006 Choi ..... G09G 3/3266 714/731
(Continued)

FOREIGN PATENT DOCUMENTS

CN 101097335 A 1/2008
CN 101153967 A 4/2008
(Continued)

OTHER PUBLICATIONS

Examination report of Indian Patent Application No. 201724030410 dated Oct. 17, 2019.

*Primary Examiner* — Jonathan M Blancha
(74) *Attorney, Agent, or Firm* — Kilpatrick Townsend & Stockton, LLP

(57) ABSTRACT

An organic light-emitting display panel, an organic light-emitting display apparatus and a driving method of the organic light-emitting display panel are provided. The organic light-emitting display panel includes a data line and a gate line intersecting the data line, a switching signal line, a pixel driving circuit including a first voltage terminal for supplying a high-level direct current voltage, a driving transistor, a light-emitting diode and a photosensitive switch electrically connected between the first voltage terminal and the light-emitting diode; a photosensitive element disposed at a non-display region of the organic light-emitting display panel; and a control circuit including a storage module and a control module. The photosensitive element is configured to sense environment brightness and is electrically connected with the control circuit.

18 Claims, 13 Drawing Sheets

(51) Int. Cl.
*G09G 3/3233* (2016.01)
*G09G 3/34* (2006.01)

(52) U.S. Cl.
CPC ..... *G09G 2300/0842* (2013.01); *G09G 2300/0861* (2013.01); *G09G 2320/0295* (2013.01); *G09G 2320/043* (2013.01); *G09G 2320/064* (2013.01); *G09G 2320/0626* (2013.01); *G09G 2360/144* (2013.01)

(58) Field of Classification Search
USPC ..... 345/690
See application file for complete search history.

(56) References Cited

U.S. PATENT DOCUMENTS

2008/0204380 A1 8/2008 Shin et al.
2009/0015166 A1* 1/2009 Kwon ..... G01J 1/4204 315/156
2010/0177075 A1* 7/2010 Fish ..... G09G 3/2014 345/207
2010/0320919 A1* 12/2010 Gough ..... G09G 3/20 315/158
2013/0083087 A1* 4/2013 Byun ..... G09G 3/3233 345/690
2015/0145845 A1 5/2015 Nam et al.
2015/0262546 A1* 9/2015 Ogura ..... G09G 3/3275 345/205
2015/0279278 A1* 10/2015 Park ..... G09G 3/3233 345/212
2016/0042694 A1* 2/2016 Lim ..... G09G 3/3233 345/78
2017/0372655 A1* 12/2017 Wang ..... G09G 3/3233

FOREIGN PATENT DOCUMENTS

CN 102905421 A 1/2013
CN 103956142 A 7/2014
KR 100788561 B1 12/2007
KR 100952111 B1 4/2010

* cited by examiner

ORGANIC LIGHT-EMITTING DISPLAY PANEL, ORGANIC LIGHT-EMITTING DISPLAY APPARATUS, AND DRIVING METHOD OF ORGANIC LIGHT-EMITTING DISPLAY PANEL

CROSS-REFERENCE TO RELATED APPLICATIONS

This application claims priority to a Chinese patent application No. 201710096052.7, filed on Feb. 22, 2017, and entitled "Organic Light-Emitting Display Panel, Organic Light-Emitting Display Apparatus, and Driving Method of Organic Light-Emitting Display Panel", the disclosure of which is incorporated herein by reference in entirety.

TECHNICAL FIELD

The present disclosure relates to the field of display, in particular to an organic light-emitting display panel, an organic light-emitting display apparatus, and a driving method of the organic light-emitting display panel.

BACKGROUND

In recent years, people have developed various light weight and small size flat panel display devices for replacing cathode ray tube. Examples of such flat panel display devices include a liquid crystal display panel, a plasma display panel and an electroluminescent display panel. The electroluminescent display panel realizes the normal display of the display panel through an electroluminescent device within the display panel. According to different materials of a light-emitting layer, electroluminescent devices are divided into two categories: inorganic light-emitting and organic light-emitting. The organic light-emitting device is referred to as a new generation of display technology, since the organic light-emitting device has a high response speed, a high luminous efficiency, a strong luminance, and a wide viewing angle.

A light-emitting device within the organic light-emitting display panel is a current driving light-emitting device whose light emission luminance is determined by a driving current of a driving transistor. There are large differences among various drive transistors due to factors such as working conditions, production process and the like, therefore, there exists a phenomenon of uneven screen among different pixels on the display panel due to a threshold voltage drift of the driving transistor. At present, in the existing art, the threshold voltage of the driving transistor is compensated generally by means of external compensation and internal compensation so as to eliminate the problem of uneven display caused by the threshold voltage drift. According to the external compensation, the threshold voltage of the driving transistor is acquired by an integrated process unit (other than the pixel driving circuit itself) of the organic light-emitting display panel, and then a data voltage is compensated based on the acquired threshold voltage. According to the internal compensation, the acquisition and compensation of the threshold voltage of the driving transistor is completed by the pixel driving circuit itself.

In practical applications, organic light-emitting display devices are often in an environment whose brightness is continually varying, it is urgent to adjust a display mode according to the brightness of the environment where the organic light-emitting display devices are located so as to compensate the luminance. Although both of the external compensation and the internal compensation can effectively overcome the problem of uneven screen generated due to the threshold voltage shift of the driving transistor, the luminance cannot be effectively compensated according to the environment brightness so as to improve an over bright or over dark visual experience appearing when being observed by human eyes.

SUMMARY

In view of this, one of the objectives of the present disclosure is to provide an organic light-emitting display panel, a driving method of the organic light-emitting display panel. The organic light-emitting display panel can sense environment brightness quickly and adjust a light emission luminance of a display screen according to the environment brightness, thereby avoiding a problem of an over bright or over dark when being observed by human eyes.

According to an aspect of the present disclosure, there provides an organic light-emitting display panel including a data line and a gate line intersecting the data line; a switching signal line; a pixel driving circuit including a first voltage terminal for supplying a high-level direct current voltage, a driving transistor, a light-emitting diode and a photosensitive switch electrically connected between the first voltage terminal and the light-emitting diode, a control terminal of the photosensitive switch is electrically connected with the switching signal line; a photosensitive element disposed at a non-display region of the organic light-emitting display panel; and a control circuit including a storage module and a control module. The photosensitive element is configured to sense environment brightness and is electrically connected with the control circuit. The storage module of the control circuit is configured to store the environment brightness sensed by the photosensitive element. The control module controls a time duration of an enable signal on the switching signal line in a light-emitting phase based on the sensed environment brightness, and the enable signal is an electrical signal which turns on the photosensitive switch.

According to an aspect of the present disclosure, there provides a method for driving the above organic light-emitting display panel. The driving method includes a light-sensing phase and a light-emitting phase. In the light-sensing phase, the photosensitive element senses the environment brightness and transmits it to the control circuit, and the control circuit stores the sensed environment brightness in the storage module. In the light-emitting phases, the control module of the control circuit controls the time duration of the enable signal on the switching signal line based on the sensed environment brightness.

According to an aspect of the present disclosure, there provides an organic light-emitting display apparatus including the above organic light-emitting display panel.

Compared with the related art, according to the organic light-emitting display panel, the organic light-emitting display apparatus and the driving method of the organic light-emitting display panel, the photosensitive element is disposed in the non-display region and senses the brightness of the environment where the display panel is located in time, and transmits the sensed environment brightness information to the control circuit in time. The control circuit controls the length of conduction time of the photosensitive switch in the pixel driving circuit according to the sensed environment brightness, thus controls the light-emitting time of the light-emitting diode in the pixel circuit under different environment brightness so as to produce different accumulation of luminance in human eyes, thereby avoiding the problem of over bright or over dark when being observed by human eyes and realizing the luminance compensation simply and effectively.

BRIEF DESCRIPTION OF DRAWINGS

In order to more clearly illustrate the technical solutions of the embodiments of the present disclosure, the accompanying drawings, which are used in the description of the related art or the embodiments, are briefly described. Apparently, the accompanying drawings are some embodiments of the present disclosure, and other accompanying drawings may be obtained based on these accompanying drawings by those skilled in the art without paying inventive work.

DETAILED DESCRIPTION

In order to make the foregoing objects, features and advantages of the present disclosure more apparent and understandable, the disclosure will be further described below in conjunction with the accompanying drawings and embodiments.

It should be noted that specific details are set forth in the following description so as to fully understand the disclosure. However, the present disclosure may be embodied in various other manners which are different from that described herein, and those skilled in the art may make similar generalizations without departing from the spirit of the present disclosure. Therefore, the present disclosure is not limited to the specific embodiments disclosed below.

Figure 1:
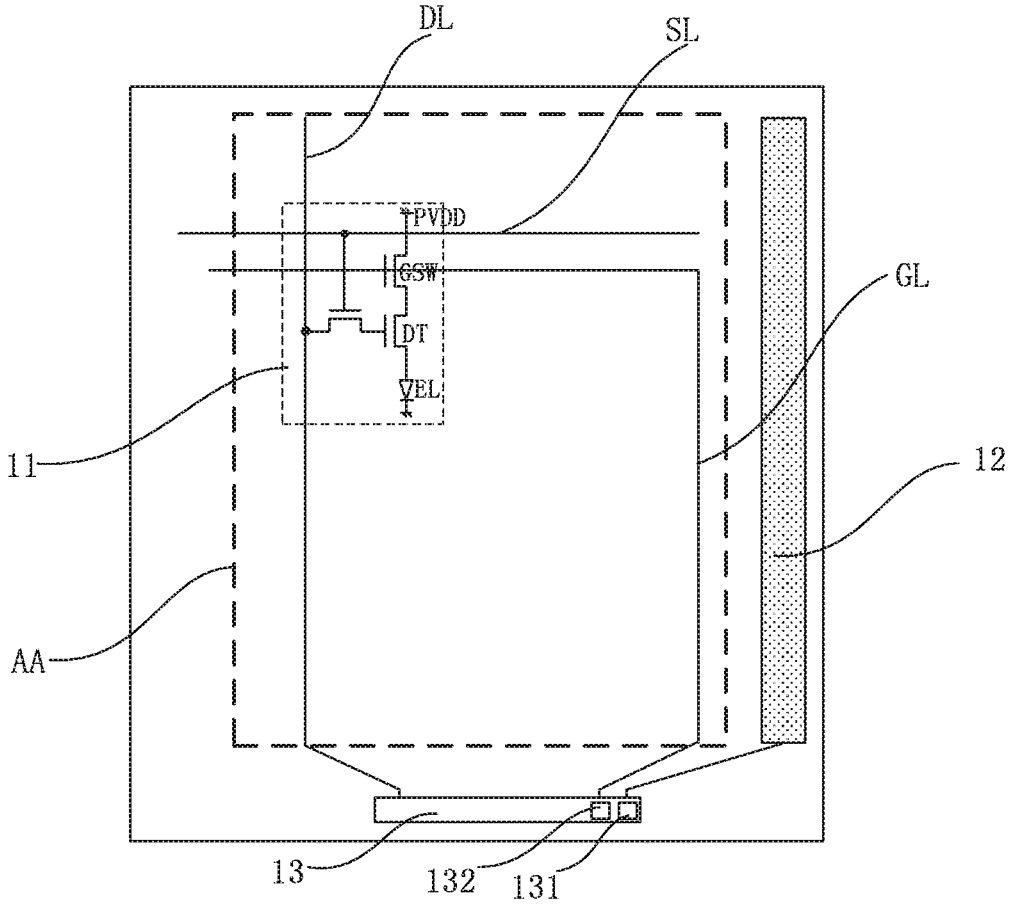
FIG. 1 is a schematic diagram showing an organic light-emitting display panel according to an embodiment of the present disclosure.

FIG. 1 is a schematic diagram showing an organic light-emitting display panel according to the present disclosure. As shown in FIG. 1, the organic light-emitting display panel includes: data lines DL, gate lines SL intersecting the data lines DL, and switching signal lines GL. In the embodiment of the present disclosure, optionally, the switching signal lines GL and the gate lines SL are disposed at a same layer, and are prepared by means of a same process and a same material. The organic light-emitting display panel further includes a pixel driving circuit 11 for driving a pixel unit of the organic light-emitting display panel to emit light. Each pixel driving circuit 11 is electrically connected with at least one gate line SL, and the turning on and turning off of the pixel driving circuit is determined based on a scan signal on the gate line SL. Each pixel driving circuit 11 is further electrically connected with one data line DL to receive a data signal voltage.

As shown in FIG. 1, in the present embodiment, each pixel driving circuit includes a driving transistor DT, a photosensitive switch GSW and a light-emitting diode EL. The photosensitive switch GSW is electrically connected between the light-emitting diode EL and a first voltage terminal PVDD configured to provide a direct current voltage of a high-level. A control terminal of the photosensitive switch GSW is electrically connected with the switching signal line GL. In this embodiment, optionally, the photosensitive switch GSW is designed to be a thin film transistor, the type of which is the same with that of the driving transistor DT.

In various embodiments, given that the driving transistor DT is kept being turned on in a light-emitting phase, the longer a time duration of an enable signal (an electrical signal for turning on the photosensitive switch GSW) conveyed on the switching signal line GL is, the longer a time duration of a conductive channel formed between the first voltage terminal PVDD and the light-emitting diode EL is, and the longer a luminescence time of the light-emitting diode EL is, the higher an accumulated light emission luminance is. Therefore, different light emission luminance of the organic light-emitting display panel is realized by means of controlling the time duration of the enable signal on the switching signal line GL.

Continuing to refer to FIG. 1, the organic light-emitting display panel further includes a photosensitive element 12 for sensing the environment brightness. It should be noted that the environment brightness described in the present disclosure is referred to the environment brightness excluding the own light emission luminance of the display panel. Therefore, in order to reduce an interference of the own light emission luminance of the organic light-emitting display panel to a sensing signal of the photosensitive element, in an embodiment of the present disclosure, the photosensitive element 12 is disposed at a non-display region of the organic light-emitting display panel (for example, an area other than dashed box AA).

As shown in FIG. 1, the organic light-emitting display panel further includes a control circuit 13 that is electrically connected with the photosensitive element 12. The control circuit 13 includes a storage module 131 and a control module 132. After the photosensitive element 12 senses the environment brightness, a value of the sensed environment brightness is stored by the storage module 131 of the control circuit 13, and the control module 132 controls the time duration of the enable signal on the switching signal line GL according to the stored environment brightness. That is, when the organic light-emitting display panel is at an environment of a different brightness, the photosensitive element senses the corresponding environment brightness in time, and transmits the sensed environment brightness information to the storage module of the control circuit for storing, and then the control module of the control circuit processes the stored environment brightness information and obtain the time duration of the corresponding enable signal so as to determine the conducting duration of the photosensitive switch GSW, so that while the driving transistor DT is kept being turned on, the time duration of the conductive channel formed between the first voltage terminal PVDD and the light-emitting diode EL is controlled, thereby controlling the light-emitting time of the light-emitting diode EL and the eventual accumulated luminance in human eyes.

Therefore, in the organic light-emitting display panel provided by these embodiments, the photosensitive element disposed at the non-display region senses in time the brightness of the environment where the display panel is located, and transmits the sensed environment brightness information to the control circuit in time, and the control circuit controls, according to the sensed environment brightness, the conducting duration of the photosensitive switch in the pixel driving circuit in the light-emitting phase so as to control the light-emitting time of the light-emitting diode in the pixel circuit under different environment brightness to produce different accumulated luminance, thereby avoiding a problem of over bright or over dark which occurs during the observation of human eyes and simply and effectively realizing the luminance compensation.

Figure 2A:
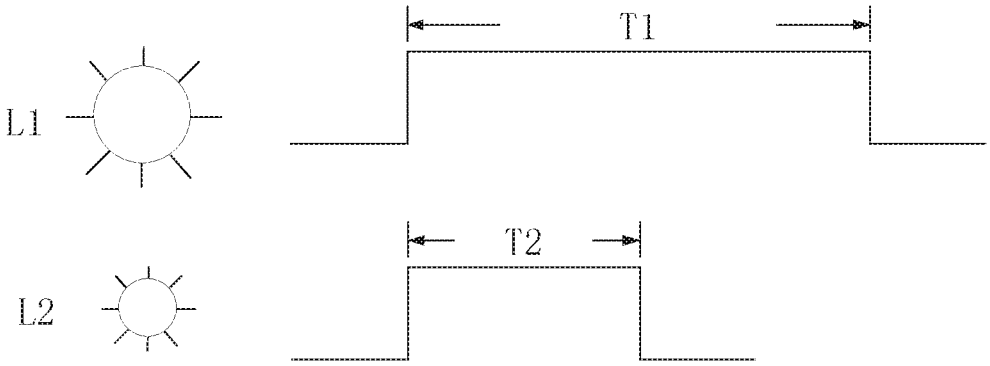
FIG. 2A-2B are schematic diagrams showing time durations of an enable signal on a switching signal line under different environment brightness according to an embodiment of the present disclosure.
Figure 2B:
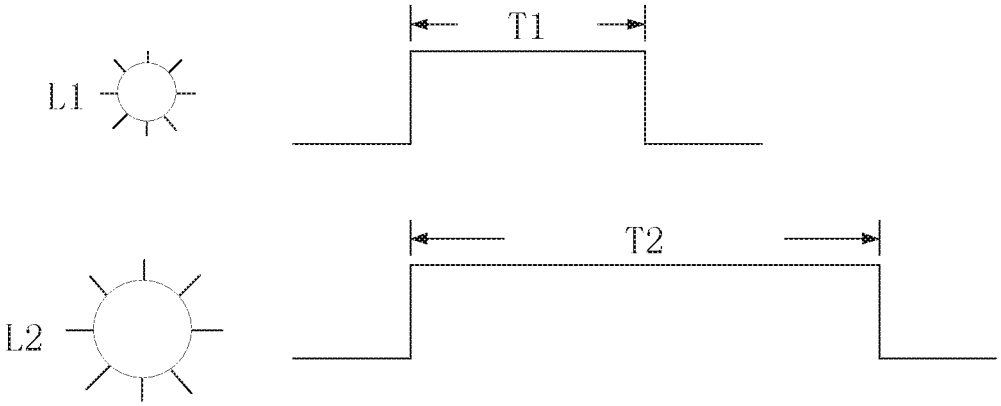

In a high-brightness environment, the organic light-emitting display panel needs to increase the corresponding light emission luminous so as to meet the needs of human eye observation, while in a low-brightness environment, the organic light-emitting display panel needs to reduce the corresponding light emission luminous so as to meet the needs of human eye observation. Therefore, the time duration of the enable signal on the switching signal line in the high-brightness environment is longer than the time duration of the enable signal on the switching signal line in the low-brightness environment under the control of the control circuit. Specifically, when the environment brightness is L1, the photosensitive element sense the environment brightness and transmits the sensed environment brightness information to the control circuit, and the control module of the control circuit processes the corresponding signal and controls the time duration of the enable signal to be T1; when the environment brightness is L2, the photosensitive element sense the environment brightness and transmits the sensed environment brightness information to the control circuit, and the control module of the control circuit processes the corresponding signal and controls the time duration of the enable signal to be T2. As shown in FIG. 2A, if L1 is greater than L2, T1 is greater than T2. As shown in FIG. 2B, if L1 is less than L2, T1 is less than T2. In this way, the light-emitting time of the light-emitting diode in the high-brightness environment is longer than the light-emitting time of the light-emitting diode in the low-brightness environment, so that the accumulation amount in human eyes of the display luminance of the organic light-emitting display panel in the high-brightness environment is greater than the accumulation amount in human eyes of the display luminance of the organic light-emitting display panel in the low-brightness environment, thereby realizing the luminance compensation of the organic light-emitting display panel and overcoming the over bright or over dark visual experience appearing when being observed by human eyes.

Figure 3:
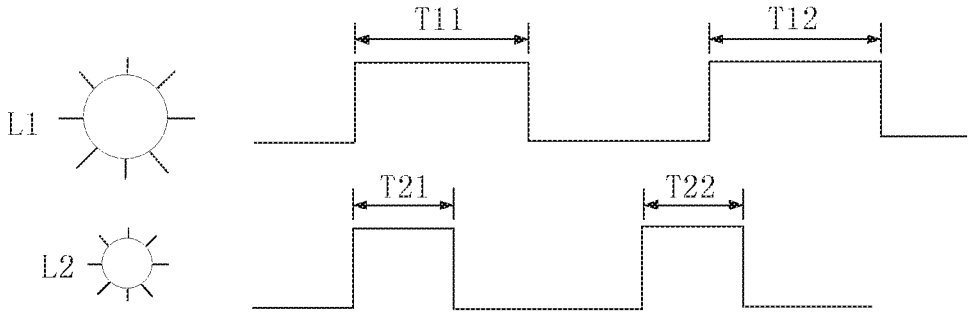
FIG. 3 is a schematic diagram showing time durations of the enable signal on the switching signal line under different environment brightness according to an embodiment of the present disclosure.

Further, in the case where the overall light-emitting time is constant, the light-emitting time may be divided to reduce a flicker of the screen. As shown in FIG. 2A, the overall light-emitting time is T1 when the environment brightness is L1; the overall light-emitting time is T2 when the environment brightness is L2. In order to reduce the flicker of the screen, the time duration T1 may be equally divided into n sub time durations, the time duration T2 may be equally divided into m sub time durations, where n and m are integers greater than or equal to 2, n may be equal to m, or n may be not equal to m. As shown in FIG. 3, T1 may be equally divided into 2 sub time durations (T11 and T12), T2 may be equally divided into 2 sub time durations (T21 and T22).

It should be noted that, in various embodiments, the photosensitive element 12 transmits the sensed environment brightness information to the control circuit 13. The environment brightness information refers to electrical signal information in one to one correspondence with the environment brightness information. For example, when the resistance value of the photosensitive element 12 varies with the variation of the environment brightness, the photosensitive element 12 is of different resistance values under different environment brightness, therefore, the sensing of different environment brightness can be realized by transmitting different resistance values to the control circuit.

Figure 4:
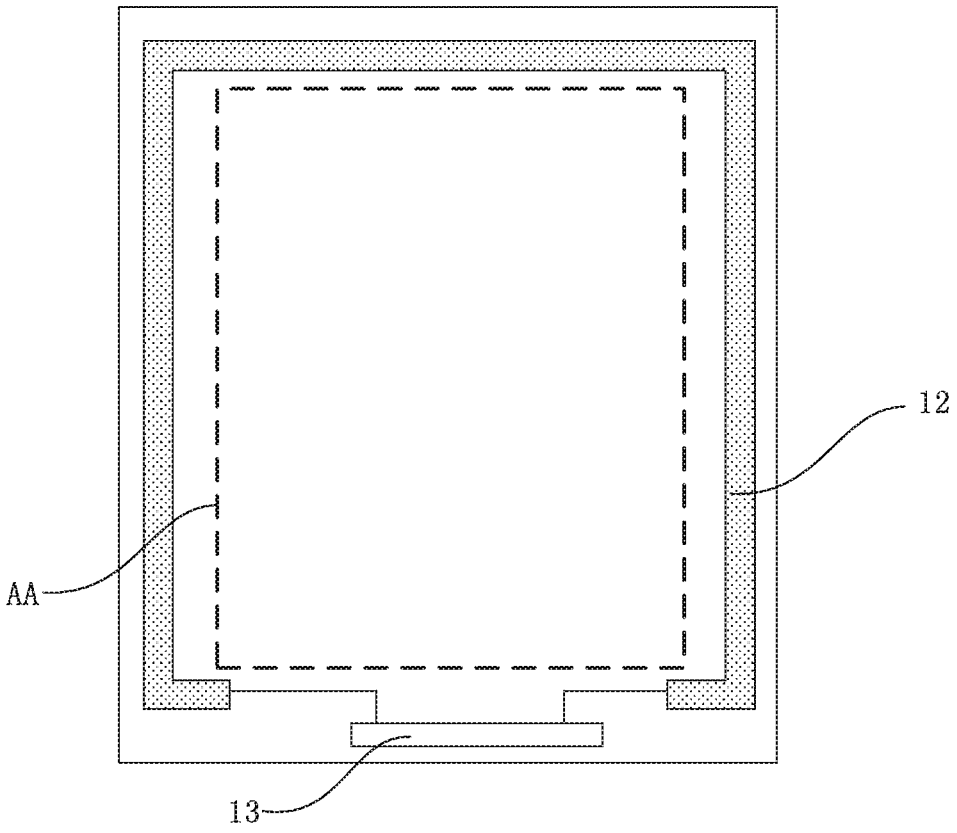
FIG. 4 is a schematic diagram showing another organic light-emitting display panel according to an embodiment of the present disclosure.

Further, in order to realize the sensing of environment brightness more adequately, uniformly and efficiently, multiple locations of the non-display region of the organic light-emitting display panel are provided with the photosensitive element 12. FIG. 4 is a schematic diagram showing another organic light-emitting display panel according to an embodiment of the present disclosure, the photosensitive element 12 is disposed at the non-display region of the organic light-emitting display panel (an region outside of a dashed line box AA region in FIG. 4), and each of three sides of the non-display region is provided with the photosensitive element 12. In this way, when light of external environment irradiates the organic light-emitting display panel, the photosensitive element 12 at multiple locations can sense the light of external environment from multiple directions, thereby improving the efficiency and accuracy of the sensing.

It should be noted that, the orientation terms such as "left", "right" and the like, used in embodiments of the present disclosure are described according to the perspective of the accompanying drawings, and it should not be interpreted as a limitation to embodiments of the disclosure.

Optionally, as shown in FIGS. 1 and 4, the photosensitive element 12 may be arranged to an independent complete element disposed at the non-display region of the organic light-emitting display panel.

Figure 5:
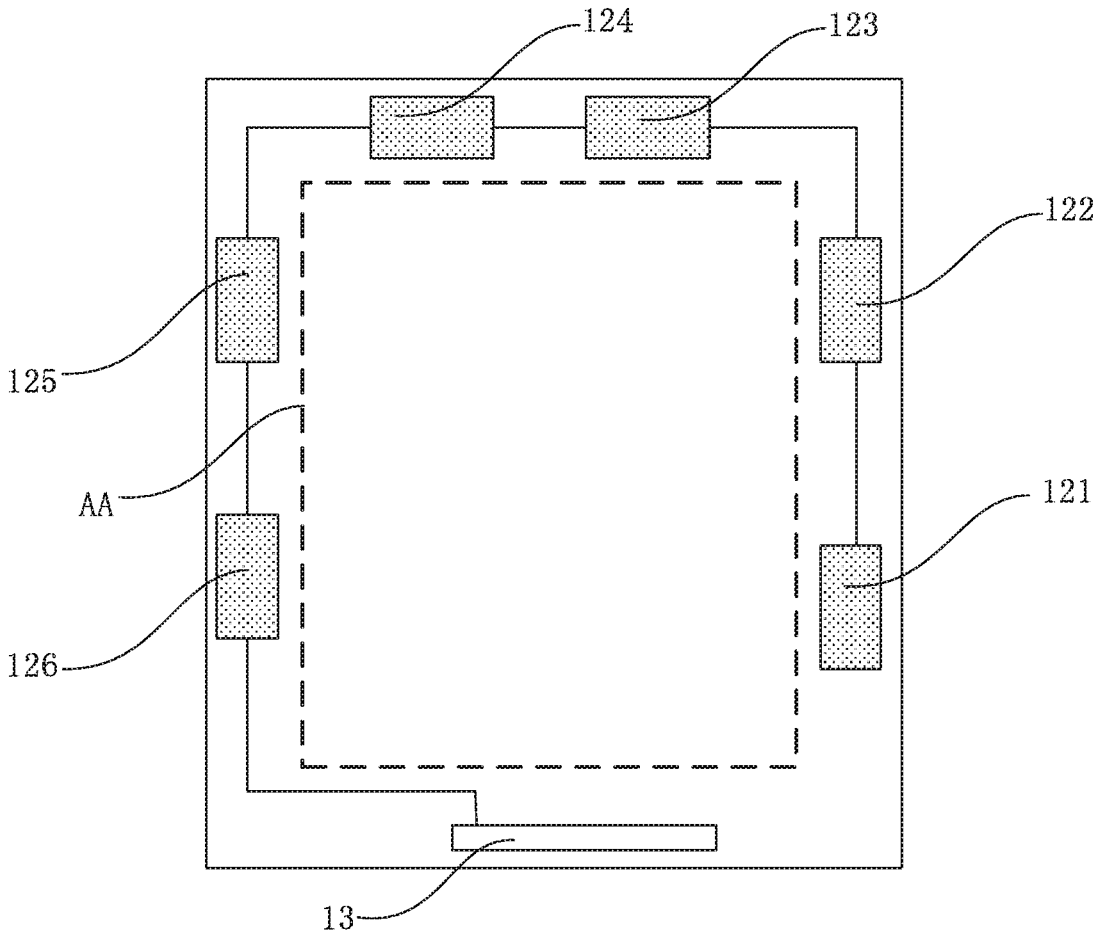
FIG. 5 is a schematic diagram showing another organic light-emitting display panel according to an embodiment of the present disclosure.

Optionally, the photosensitive element 12 may be arranged to a plurality of photosensitive sub elements which are electrically connected in series to one another, and disposed at the non-display region of the organic light-emitting display panel. FIG. 5 is a schematic diagram showing another organic light-emitting display panel according to an embodiment of the present disclosure, the photosensitive element 12 includes a plurality of photosensitive sub elements 121, 122, . . . , 126, and these photosensitive sub elements 121, 122, . . . , 126 are connected in series to one another. Such design is beneficial to the photosensitive element's sensitivity to light. For example, when the photosensitive element is of resistive photosensitive material, the resistance of the material has a reverse relation with the cross sectional area (the larger the cross sectional area, the smaller the resistance; the smaller the cross sectional area, the larger the resistance), therefore, compared with one complete element, a rate of change in resistances of the plurality of photosensitive sub elements is higher, and their sensitivity to light is higher. It should be noted that the photosensitive sub elements 121, 122, . . . , 126 shown in FIG. 5 are merely exemplary illustrations and do not constitute a limitation on the particular number of photosensitive sub elements.

In the embodiment shown in FIG. 1, the control circuit 13 and the switching signal line GL are directly connected. After sensing the environment brightness, the photosensitive element 12 transmits the sensed environment brightness information to the control circuit 13. The control module of the control circuit 13 directly controls the time duration of the enable signal on the switching signal line GL after processing the corresponding information.

Figure 6:
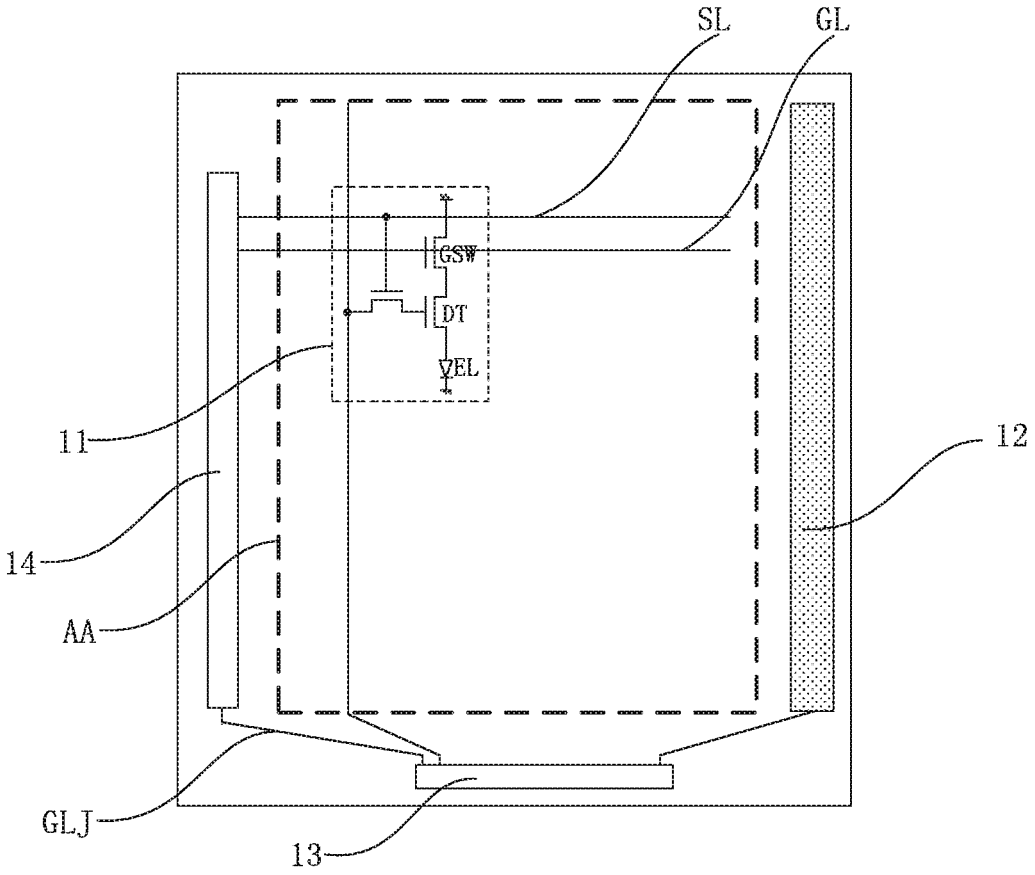
FIG. 6 is a schematic diagram showing another organic light-emitting display panel according to an embodiment of the present disclosure.

Optionally, the organic light-emitting display panel further includes a gate driving circuit, through which the control circuit is connected with the switching signal line. FIG. 6 is a schematic diagram showing another organic light-emitting display panel according to an embodiment of the present disclosure. The organic light-emitting display panel includes a gate driving circuit 14. The control circuit 13 is connected with the gate driving circuit 14 through the switching signal connection line GLJ, and the gate driving circuit 14 is further connected with the switching signal line GL. That is, in the embodiment shown in FIG. 6, after the sensing the environment brightness, the photosensitive element 12 transmits the sensed environment brightness information to the control circuit 13. After the control module of the control circuit 13 processes the corresponding information, the processed information is transmitted to the gate driving circuit 14, and then the control module of the control circuit 13 controls the time duration of the enable signal on the switching signal line GL through the gate driving circuit 14.

Figure 7:
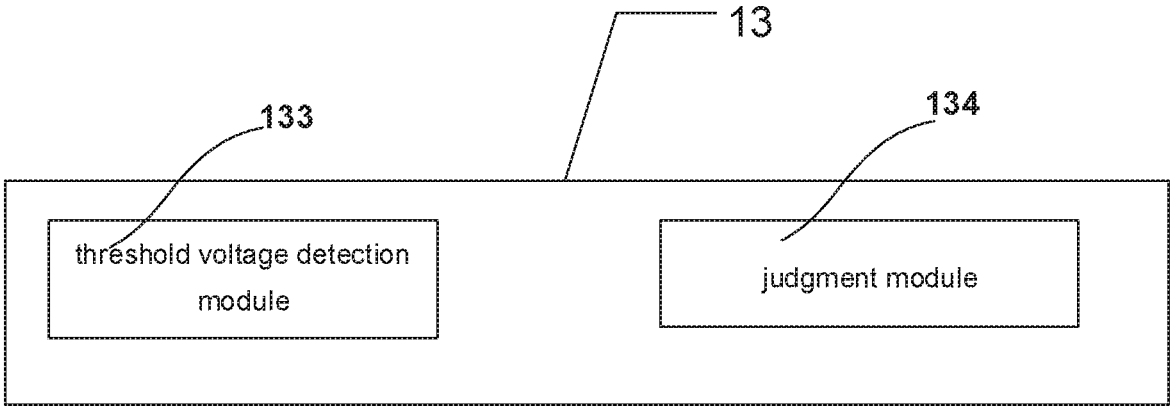
FIG. 7 is a schematic diagram showing a structure of a control circuit according to an embodiment of the present disclosure.

Further, as shown in FIG. 7, the control circuit provided by this embodiment may further include a threshold voltage detection module 133 for compensating the threshold voltage of the driving transistor in the pixel driving circuit. In the organic light-emitting display panel, driving transistors in different pixel units may have different threshold voltages Vth and mobility due to process variation, causing that the driving current of the light-emitting element is different for each pixel unit, and a characteristic difference among the driving transistors of the pixel units is generated. Generally, the initial characteristic difference among the driving transistors may result in unevenness or pattern on the screen, and the characteristic difference due to the deterioration of the driving transistor during the light-emitting element being driven by the driving transistor will significantly reduce the life of the display panel or result in image sticking. Therefore, the control circuit provided by the embodiment of the present disclosure is provided with the threshold voltage detection module, which can detect and compensate the threshold voltage of the driving transistor, the problem of uneven display due to the drift of the threshold voltage of the driving transistor is avoided.

Figure 8A:
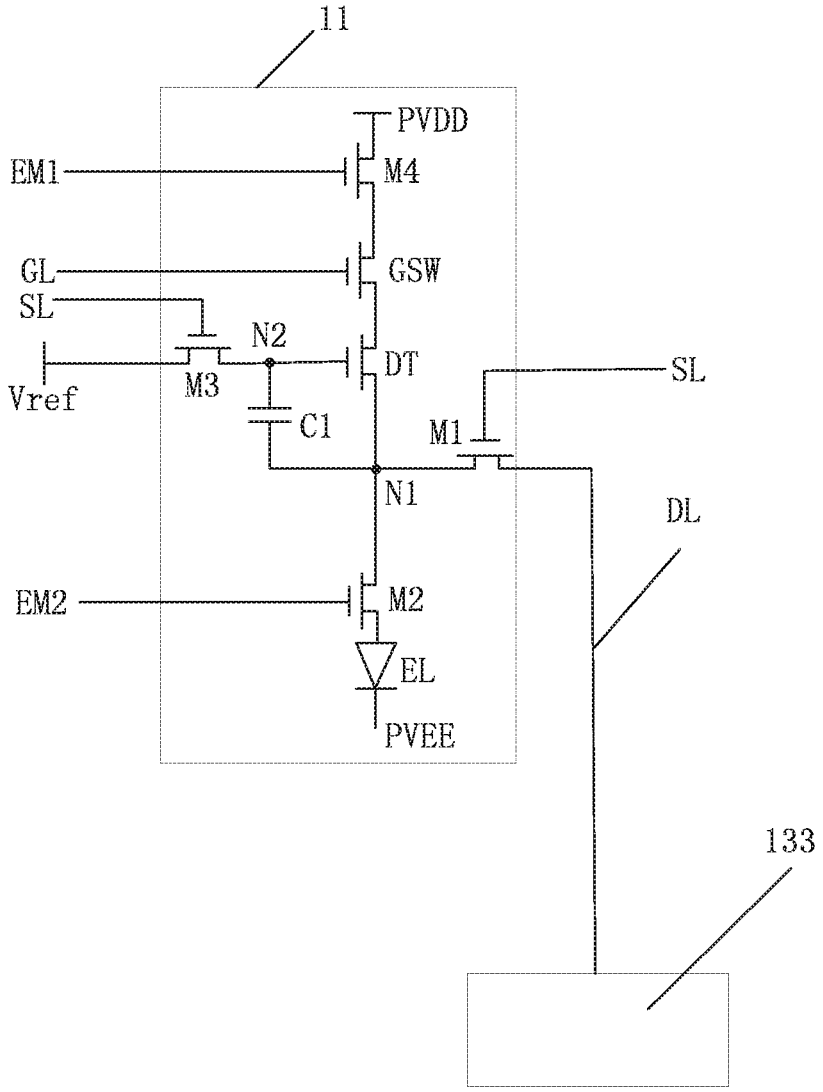
FIG. 8A is a schematic diagram showing a structure of a pixel driving circuit according to an embodiment of the present disclosure.

FIG. 8A is a schematic diagram showing a structure of a pixel driving circuit according to an embodiment of the present disclosure. As shown in FIG. 8A, the pixel driving circuit 11 and the threshold voltage detection module 133 are electrically connected through the data line DL. In addition to the first voltage terminal PVDD for supplying the direct current voltage of high-level, the driving transistor DT, the photosensitive switch GSW and the light-emitting diode EL, the pixel driving circuit 11 further includes a first transistor M1, a second transistor M2, a third transistor M3, a fourth transistor M4 and a first capacitor C1. A gate electrode of the first transistor M1 is electrically connected with the gate line SL, a first electrode is connected with the data line DL, and a second electrode is electrically connected with a gate electrode of the driving transistor DT. A gate electrode of the second transistor M2 is electrically connected with a second light-emitting control line EM2, a first electrode is electrically connected with a source electrode of the driving transistor DT, and a second electrode is electrically connected with an anode of the light-emitting diode EL. A gate electrode of the third transistor M3 is electrically connected with the gate line SL, a first electrode is electrically connected with a reference voltage terminal Vref. and a second electrode is electrically connected with the gate electrode of the driving transistor DT. A gate electrode of the fourth transistor M4 is electrically connected with a first light-emitting control line EM1, a first electrode is electrically connected with the first voltage terminal, and a second electrode is electrically connected a drain electrode of the driving transistor DT. One terminal of the first capacitor C1 is electrically connected with the gate electrode of the driving transistor DT, and the other terminal of the first capacitor C1 is electrically connected with the source electrode of the driving transistor DT.

Figure 8B:
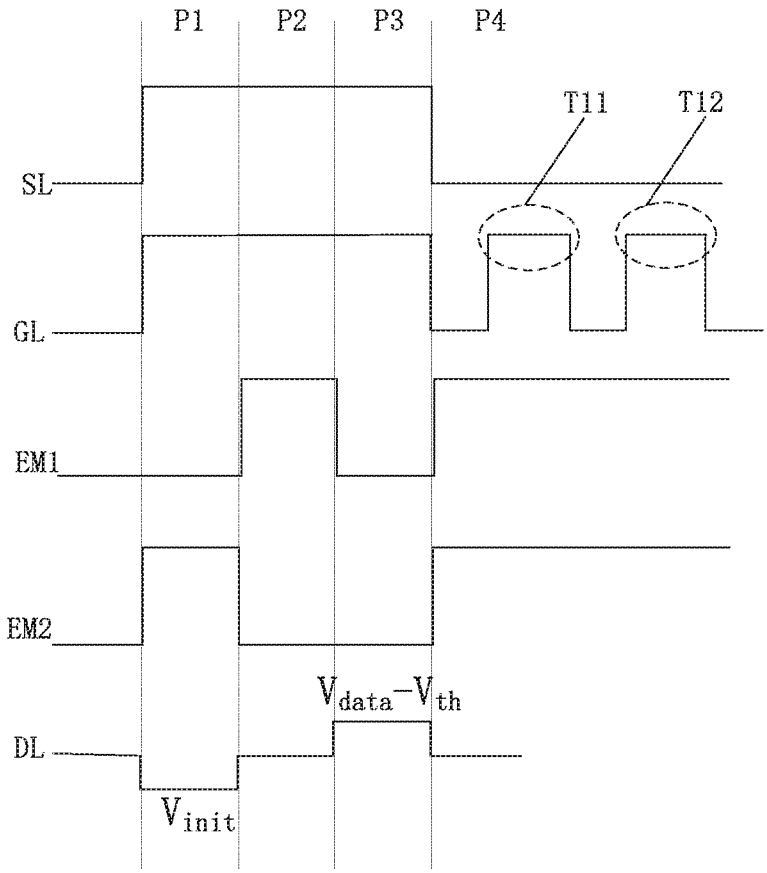
FIG. 8B is a driving timing diagram of the pixel driving circuit shown in FIG. 8A.

FIG. 8B is a driving timing diagram of the pixel driving circuit shown in FIG. 8A. P1~P3 are a threshold voltage detection phase, and P4 is a light emitting phase. The specific operating process will be described by taking a situation that the transistors in the pixel driving circuit shown in FIG. 8A are NMOS (N-Channel Metal-Oxide-Semiconductor) transistors as an example. As shown in FIG. 8B, in the threshold voltage detection phase (P1~P3), the signal of the switching signal line GL is maintained at high-level throughout, while it is at high-level merely in time periods T11 and T12 during in the stage P4. Therefore, the photosensitive switch GSW is maintained conductive in the threshold voltage detection phase, and maintained conductive in the time periods T11 and T12 in the stage P4. It should be noted that the T11 and T12 herein are merely for exemplary description, but should not be construed as the specific limitation to the light-emitting phase P4 in FIG. 8B.

Specifically, in the stage P1, the scan line SL and the second light-emitting control line EM2 are supplied with high-level signals, and the first light-emitting control line EM1 is supplied with a low-level signal. At this moment, under the control of high-level signals on the scan line SL, the second light-emitting control line EM2 and the switching signal line GL, the first transistor M1, the second transistor M2, the third transistor M3 and the photosensitive switch GSW are turned on. Meanwhile, the threshold voltage detection module 133 conveys an initial voltage signal $V_{initial}$, the $V_{initial}$ is transmitted to the anode of the organic light-emitting diode EL through the first transistor M1 and the second transistor M2 which are turned on, and the anode of the organic light-emitting diode EL is initialized. Meanwhile, the reference voltage line Vref is transmitted to the second node N2 through the conductive third transistor M3. Therefore, in the stage P1, the voltage of the first node N1 is $V_{initial}$, and the voltage of the second node N2 is Vref.

In the stage P2, the scan line SL, the first light-emitting control line EM1 are supplied with high-level signals, and the second light-emitting control line EM2 is supplied with the low-level signal. Meanwhile, under the control of the high-level signals of the scan line SL, the first light-emitting control line EM1, the first transistor M1, the fourth transistor M4 and the photosensitive switch GSW are turned on. Meanwhile, the driving transistor DT is turned on at this moment after the initialization of the previous stage. Therefore, the high-level direct current voltage PVDD supplied by the first voltage terminal PVDD is transmitted to the first node N1 through the fourth transistor M4, the photosensitive switch GSW, and the driving transistor DT which are turned on, so that the potential of the first node N1 keeps rising. The driving transistor DT is turned off when the potential of the first node N1 rises to $V_{ref}-V_{th}$. The potential of the first node N1 is transmitted to the threshold voltage detection module 133 through the conducting driving transistor DT.

In the stage P3, a high-level signal is supplied to the scan line SL, low-level signals are supplied to the first light-emitting control line EM1 and the second light-emitting control line EM2. At this moment, under the control of the high-level signal of the scan line SL, the first transistor M and the third transistor M3 are turned on, the threshold voltage detection module 133 carries out a calculation process on the threshold voltage $V_{th}$ obtained in the stage P2 and outputs a voltage of $V_{data}-V_{th}$ to the first node N1 (that is, the source electrode of the driving transistor DT) through the data line DL so as to accomplish the threshold voltage compensation of the driving transistor DT.

In the stage P4, high-level signals are supplied to the first light-emitting control line EM1 and the second light-emitting control line EM2, and a low-level signal is supplied to the scan line SL. At this moment, under the control of the high-level signals of the first light-emitting control line EM1 and the second light-emitting control line EM2, the fourth transistor M4 and the second transistor M2 are turned on. After the threshold voltage compensation in the previous stage, the driving transistor DT is turned on at this moment. The driving current I of the organic light-emitting diode EL is $I=k*(V_{gs}-V_h)^2=k*(V_{ref}-V_{data})^2$, that is, the driving current of the organic light-emitting diode EL is not affected by the threshold voltage drift.

In the stage P4, the environment brightness differs, and the outputting time period TX of the enable signal (the high-level signal in FIG. 8B) on the GL differs. Therefore, the length of the conducting time of the photosensitive switch GSW also differs. The duration time of a conductive channel formed between the first voltage terminal PVDD and the second voltage terminal PVEE also differs. Thus, the outputting time length of the driving current differs, and finally the light emission luminance of the organic light-emitting diode EL differs.

Therefore, the embodiment shown in FIG. 8A to FIG. 8B can not only realize the threshold voltage detection by means of the external compensation manner, but also generate different light emission luminance according to specific environment brightness, thereby realizing the luminance compensation.

As shown in FIG. 8A, the photosensitive switch GSW is electrically connected between the first voltage terminal PVDD and the drain electrode of the driving transistor DT. It can be known through the analysis of the specific operating process that the photosensitive switch GSW must be maintained at the conductive state in order to ensure the successful completion of the threshold voltage detection process. Correspondingly, in the driving timing shown in FIG. 8B, the switching signal line GL is maintained at the high-level throughout the threshold voltage detection phase.

Therefore, in order to ensure that the switching signal line GL is maintained at the high-level throughout the threshold voltage detection phase unlike the light-emitting phases in which the high-level signal varies with the variation of specific environment brightness, the control circuit of the embodiment of the present disclosure further includes a judgment module 134 for judging whether the threshold voltage detection module is carrying out the detection of the threshold voltage of the driving transistor. As shown in FIG. 7, when the judgment module determines that the threshold voltage detection module is carrying out the detection of the threshold voltage of the driving transistor, the control module of the control circuit controls the switching signal line to output a stable enable signal. That is, when the judgment module determines that the threshold voltage detection module is carrying out the detection of the threshold voltage of the driving transistor, the control module of the control circuit outputs the stable enable signal regardless of the environment brightness, thereby ensuring the successful completion of the threshold voltage detection process.

It should be noted that, FIG. 8A merely exemplarily illustrates a pixel driving circuit applicable to the external compensation, but does not constitute a limitation to the external compensation pixel driving circuit of the present disclosure.

It should be noted that the control circuit 13 of the embodiment of the present disclosure may be integrated with a function of transmitting data signal voltage to the data line. However, this is not limited by the present disclosure, and the data signal voltage on the data line DL may be controlled by other integrated circuits.

Moreover, the present disclosure further discloses a driving method of the organic light-emitting display panel for driving the organic light-emitting display panel described in each above embodiment.

Figure 9:
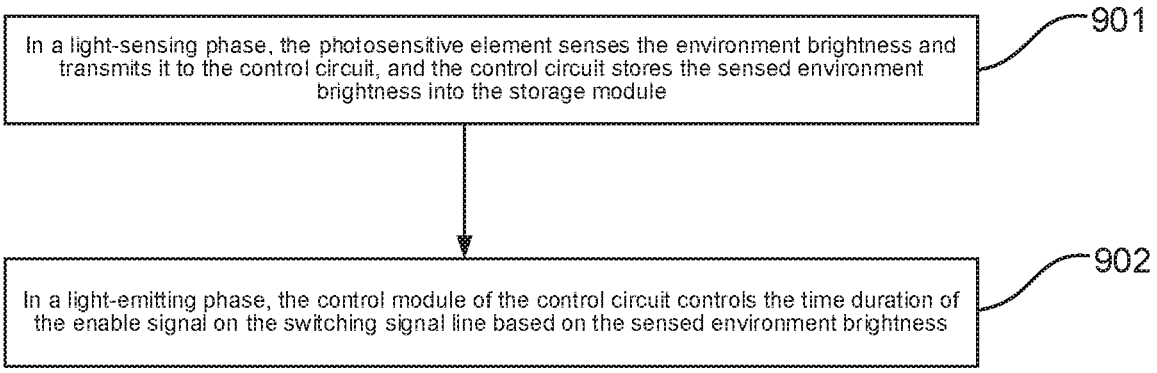
FIG. 9 is a schematic diagram showing a driving method according to an embodiment of the present disclosure.

As shown in FIG. 9, the driving method includes a light-sensing phase and a light-emitting phase.

In step 901, in the light-sensing phase, the photosensitive element senses the environment brightness and transmits it to the control circuit, and the control circuit stores the sensed environment brightness in the storage module.

In step 902, in the light-emitting phase, the control module of the control circuit controls the time duration of the enable signal on the switching signal line based on the sensed environment brightness.

Specifically, in the step 901, the photosensitive element converts the sensed environment brightness information to electrical information and transmits the electrical information to the control circuit, and the corresponding electrical information is stored in the storage module. In the step 902, the control module of the control circuit calls the electrical information stored in the storage module, and obtains the time duration of the enable signal by processing. The time duration of the enable signal is T1 when the environment brightness sensed by the photosensitive element is L1; and the time duration of the enable signal is T2 when the environment brightness sensed by the photosensitive element is L2. T1 is greater than T2 when L1 is greater than L2. T1 is less than T2 when L1 is less than L2.

It should be noted that the control module may be configured with a table of "environment brightness—time duration of enable signal" in advance. Different environment brightness values correspond to different time durations of enable signal, and a high environment brightness value corresponds to a longer time duration of enable signal. As shown in Table 1, when the photosensitive element senses environment brightness LX, the brightness information LX is firstly converted into the corresponding electrical information RX which is transmitted to the storage module of the control circuit, and then the control module of the control circuit calls the Table 1 and find the time duration TX of the enable signal corresponding to the electrical information RX. Thus, when the organic light-emitting display panel is under different environment brightness, the time duration of the enable signal differs, and the light-emitting time of the light-emitting diode differs, and the final accumulated amount of the luminance in human eyes differs, thereby avoiding the over bright or over dark problem when being observed by human eyes.

TABLE 1 time durations of the enable signal under different environment brightness values

| | | | | |
|---|---|---|---|---|
| Environment brightness | L1 | L2 | . . . | LX |
| Resistance value | R1 | R2 | . . . | RX |
| Time duration of the enable signal | T1 | T2 | . . . | TX |

Further, for a certain environment brightness, the time duration, corresponding to the certain environment brightness, of the enable signal on the switching signal line may be equally divided multiple times so as to reduce the flashing on the screen. For example, the time duration T1 may be equally divided into n sub time durations, the time duration T2 may be equally divided into m sub time durations, where n and m are integers greater than 2. In an embodiment, n is equal to m. In another embodiment, n and m are not equal.

Further, the driving method of the present embodiment further includes a threshold voltage detection phase.

Figure 10:
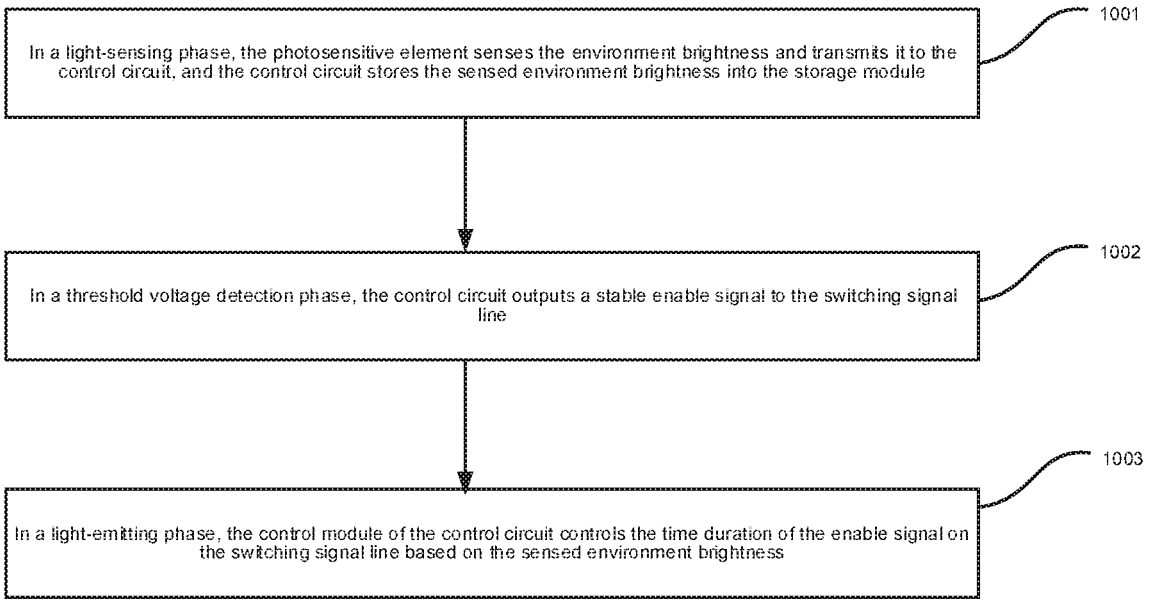
FIG. 10 is a schematic diagram showing another driving method according to an embodiment of the present disclosure.

As shown in FIG. 10, the driving method provided by the present embodiment includes steps 1001 to 1003.

In step 1001, a light-sensing phase, the photosensitive element senses the environment brightness and transmits it to the control circuit, and the control circuit stores the sensed environment brightness into the storage module.

In step 1002, a threshold voltage detection phase, the control circuit outputs a stable enable signal to the switching signal line.

In step 1003, a light-emitting phase, the control module of the control circuit adjusts the time duration of the enable signal on the switching signal line based on the sensed environment brightness.

That is, the driving method provided by the embodiment is applicable to the organic light-emitting display panel with threshold voltage compensation. In order to ensure the successful proceeding of the threshold voltage compensation process, in the threshold voltage compensation process, the control circuit outputs a stable enable signal to the switch signal line regardless of the environment brightness. The specific pixel driving circuit is not limited by the present disclosure, and the specific process of the threshold voltage detection varies with the specific pixel driving circuit. Therefore, the specific process of the threshold voltage detection is not described in the description of the driving method of the present disclosure. Regardless of the design of the pixel circuit, in order to ensure the successful proceeding of the threshold voltage compensation process, in the threshold voltage compensation process, the control circuit outputs the stable enable signal to the switch signal line regardless of the environment brightness.

Figure 11:
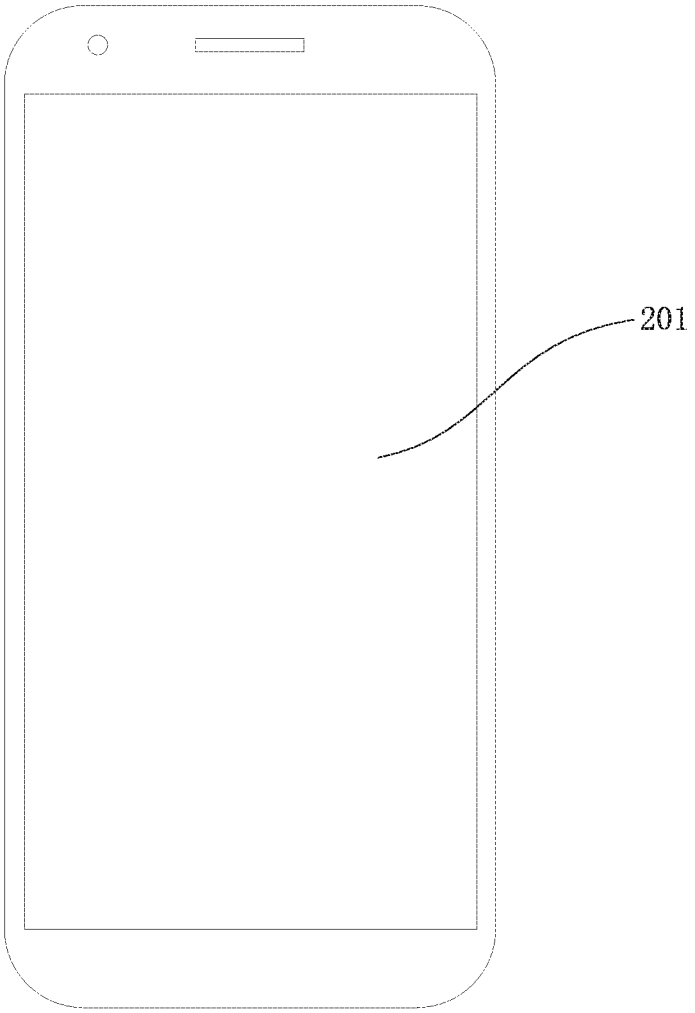
FIG. 11 is a schematic diagram showing an organic light-emitting display apparatus according to an embodiment of the present disclosure.

In addition, the present disclosure further provides an organic light-emitting display apparatus including the organic light-emitting display panel described in any above embodiment. The display apparatus includes a smart phone, a smart watch, a laptop and the like, which is not limited by the present disclosure. FIG. 11 is a schematic diagram showing an organic light-emitting display apparatus (smart phone) according to an embodiment of the present disclosure. The apparatus includes an organic light-emitting display panel 201 which is the organic light-emitting display panel described in any above embodiment.

According to the organic light-emitting display panel and the driving method of the organic light-emitting display panel provided by the embodiment, the photosensitive element disposed at the non-display region senses in time the brightness of the environment where the display panel is located, and transmits the sensed environment brightness information to the control circuit in time, and the control circuit controls, according to the sensed environment brightness, the conducting duration of the photosensitive switch in the pixel driving circuit in the light-emitting phase so as to control the light-emitting time of the light-emitting diode in the pixel circuit under different environment brightness to produce different accumulated luminance, thereby avoiding a problem of over bright or over dark which occurs during the observation of human eyes and simply and effectively realizing the luminance compensation.

The foregoing is a further detailed description of the present disclosure in connection with specific preferred embodiments, and it is not to determine that the specific implementation of the disclosure is limited to these descriptions. It will be apparent that several simple deductions or substitutions may be made by those skilled in the art without departing from the spirit of the present disclosure, and should be considered as falling within the protection scope of the present disclosure.

What is claimed is:

1. An organic light-emitting display panel, comprising:

a data line;

a gate line intersecting the data line;

a switching signal line;

a pixel driving circuit comprising a first voltage terminal for supplying a high-level direct current voltage, a driving transistor, a photosensitive switch and a light-emitting diode, wherein the photosensitive switch is electrically connected between the first voltage terminal and the light-emitting diode, and a control terminal of the photosensitive switch is electrically connected with the switching signal line;

a photosensitive element disposed at a non-display region of the organic light-emitting display panel; and a control circuit disposed in the non-display region and comprising a storage module, a threshold voltage detection module in the non-display region, a control module, and a judgment module; and, wherein the threshold voltage detection module is configured to detect a threshold voltage of the driving transistor, the photosensitive element is configured to sense environment brightness and is electrically connected with the control circuit;

the storage module of the control circuit is configured to store the environment brightness sensed by the photosensitive element; and the control module is configured to control an output time duration of an enable signal on the switching signal line in a light-emitting phase based on the sensed environment brightness, the enable signal being an electrical signal which turns on the photosensitive switch;

the judgment module configured to judge whether the threshold voltage detection module is detecting the threshold voltage of the driving transistor;

wherein when the judgment module determines that the threshold voltage detection module is detecting the threshold voltage of the driving transistor, the control module of the control circuit is configured to control the switching signal line to output a stable enable signal, the photosensitive switch is maintained to be turned on by the stable enable signal when the threshold voltage detection module is detecting the threshold voltage of the driving transistor.

2. The organic light-emitting display panel according to claim 1, wherein the time duration of the enable signal is T1 when the environment brightness is L1, the time duration of the enable signal is T2 when the environment brightness is L2, wherein T1 is greater than T2 when L1 is greater than L2 and T1 is less than T2 when L1 is less than L2.

3. The organic light-emitting display panel according to claim 2, wherein time duration T1 is equally divided into n number of sub time durations, time duration T2 is equally divided into m number of sub time durations, wherein the n and m are integers greater than or equal to 2.

4. The organic light-emitting display panel according to claim 3, wherein n=m.

5. The organic light-emitting display panel according to claim 1, wherein the control circuit is directly connected with the switching signal line.

6. The organic light-emitting display panel according to claim 1, further comprising a gate driving circuit that is directly connected with the switching signal line.

7. The organic light-emitting display panel according to claim 6, wherein the control circuit is connected with the gate driving circuit through a switching signal connection line.

8. The organic light-emitting display panel according to claim 1, wherein the photosensitive element comprises a plurality of photosensitive sub elements, which are electrically connected to one another in series.

9. The organic light-emitting display panel according to claim 1, wherein a resistance value of the photosensitive element varies as the environment brightness varies.

10. The organic light-emitting display panel according to claim 1, wherein the photosensitive switch is a thin film transistor that has a same transistor type as the driving transistor.

11. The organic light-emitting display panel according to claim 1, wherein the switching signal line and the gate line are disposed in a same layer.

12. The organic light-emitting display panel according to claim 1, wherein the threshold voltage detection module is electrically connected to the pixel driving circuit through the data line.

13. The organic light-emitting display panel according to claim 1, wherein the pixel driving circuit further comprises a first transistor, wherein a first electrode of the driving transistor is connected to the photosensitive switch, a first electrode of the first transistor is directly connected to a second electrode of the driving transistor, a second electrode of the first transistor is connected to the data line, and a gate electrode of the first transistor is connected to the gate line.

14. An organic light-emitting display apparatus, comprising an organic light-emitting display panel, wherein the organic light-emitting display panel comprises:

a data line;

a gate line intersecting the data line;

a switching signal line;

a pixel driving circuit comprising a first voltage terminal for supplying a high-level direct current voltage, a driving transistor, a photosensitive switch and a light-emitting diode, wherein the photosensitive switch is electrically connected between the first voltage terminal and the light-emitting diode, and a control terminal of the photosensitive switch is electrically connected with the switching signal line;

a photosensitive element disposed at a non-display region of the organic light-emitting display panel; and a control circuit disposed in the non-display region and comprising a storage module, a threshold voltage detection module in the non-display region, a control module, and a judgment module; and, wherein the threshold voltage detection module is configured to detect a threshold voltage of the driving transistor, the photosensitive element is configured to sense environment brightness and is electrically connected with the control circuit;

the storage module of the control circuit is configured to store the environment brightness sensed by the photosensitive element; and the control module is configured to control an output time duration of an enable signal on the switching signal line in a light-emitting phase based on the sensed environment brightness, the enable signal being an electrical signal which turns on the photosensitive switch;

the judgment module configured to judge whether the threshold voltage detection module is detecting the threshold voltage of the driving transistor;

wherein when the judgment module determines that the threshold voltage detection module is detecting the threshold voltage of the driving transistor, the control module of the control circuit is configured to control the switching signal line to output a stable enable signal, the photosensitive switch is maintained to be turned on by the stable enable signal when the threshold voltage detection module is detecting the threshold voltage of the driving transistor.

15. An organic light-emitting display panel comprising:

a data line;

a gate line intersecting the data line;

a switching signal line;

a pixel driving circuit comprising a first voltage terminal for supplying a high-level direct current voltage, a driving transistor, a photosensitive switch and a light-emitting diode, wherein the photosensitive switch is electrically connected between the first voltage terminal and the light-emitting diode, and a control terminal of the photosensitive switch is electrically connected with the switching signal line;

a photosensitive element disposed at a non-display region of the organic light-emitting display panel; and a control circuit disposed in the non-display region and comprising a storage module, a threshold voltage detection module in the non-display region, and a control module; and, wherein the threshold voltage detection module is configured to detect a threshold voltage of the driving transistor, the photosensitive element is configured to sense environment brightness and is electrically connected with the control circuit;

the storage module of the control circuit is configured to store the environment brightness sensed by the photosensitive element;

the control module is configured to control an output time duration of an enable signal on the switching signal line in a light-emitting phase based on the sensed environment brightness, the enable signal being an electrical signal which turns on the photosensitive switch; and wherein the pixel driving circuit further comprises: a first transistor, a second transistor, a third transistor, and a fourth transistor, wherein the fourth transistor is connected between the first voltage terminal and a first electrode of the photosensitive switch, a second electrode of the photosensitive switch is connected to a first electrode of the driving transistor, a second electrode of the driving transistor is connected to a first electrode of the second transistor, a second electrode of the second transistor is connected to the light-emitting diode, the first transistor is connected between the second electrode of the driving transistor and the data line, and the third transistor is connected to a gate electrode of the driving transistor, wherein a gate electrode of the first transistor and a gate electrode of the third transistor are both connected to the gate line.

16. The organic light-emitting display panel according to claim 15, wherein a gate electrode of the fourth transistor is connected to a first light-emitting control line, a gate electrode of the second transistor is connected to a second light-emitting control line, a first electrode of the third transistor is connected to a reference voltage line, and a second electrode of the third transistor is connected to the gate electrode of the driving transistor.

17. The organic light-emitting display panel according to claim 15, wherein the pixel driving circuit further comprises a capacitor, wherein a first electrode of the capacitor is connected to the gate electrode of the driving transistor, and a second electrode of the capacitor is connected to the second electrode of the driving transistor.

18. The organic light-emitting display panel according to claim 15, wherein a driving timing of the pixel driving circuit comprises a threshold voltage detection phase and a light emitting phase, wherein the threshold voltage detection phase comprises a first stage, a second stage, and a third stage, in the first stage of the threshold voltage detection phase, the first transistor and the third transistor are turned on, the photosensitive switch is turned on, the second transistor is turned on, and the fourth transistor is turned off, and the threshold voltage detection module is configured to output an initial voltage signal to the data line;

in the second stage of the threshold voltage detection phase, the first transistor and the third transistor are turned on, the photosensitive switch is turned on, the second transistor is turned off, and the fourth transistor is turned on, and the threshold voltage detection module stops outputting the initial voltage signal;

in the third stage of the threshold voltage detection phase, the first transistor and the third transistor are turned on, the photosensitive switch is turned on, the second transistor and the fourth transistor are turned off, and the threshold voltage detection module is configured to output a voltage signal to the data line, where a magnitude of the voltage signal is equal to a data voltage minus the threshold voltage of the driving transistor;

in the light emitting phase, the first transistor and the third transistor are turned off, and the second transistor and the fourth transistor are turned on.

* * * * *